United States Patent [19]

Kammann, Jr. et al.

[11] 4,331,564

[45] May 25, 1982

[54] CATALYZING THE SULFURIZATION OF OLEFINS BY TERTIARY PHOSPHINES, AND AN OIL BASED MATERIAL CONTAINING AN ADDITIVE AMOUNT OF A SULFURIZED OLEFIN SO PRODUCED

[75] Inventors: Karl P. Kammann, Jr., Crown Point; Astrid-Ilsaabe Phillips, Hammond, both of Ind.

[73] Assignee: Ferro Corporation, Cleveland, Ohio

[21] Appl. No.: 197,182

[22] Filed: Oct. 15, 1980

[51] Int. Cl.[3] ..... C10M 1/38; C07G 17/00

[52] U.S. Cl. ..... 252/45; 252/48.6; 260/399; 260/139

[58] Field of Search ..... 252/45, 48.6; 260/139, 260/399

[56] References Cited

U.S. PATENT DOCUMENTS

| | | | |
|---|---|---|---|
| 2,402,456 | 6/1946 | Signaigo | 260/139 |
| 2,500,163 | 3/1950 | Garwood | 260/139 |
| 3,689,568 | 9/1972 | Eletto et al. | 568/73 |
| 3,780,113 | 12/1973 | Martin | 568/61 X |
| 4,119,549 | 10/1978 | Davis | 252/45 |
| 4,147,640 | 4/1979 | Jayne et al. | 252/45 |
| 4,191,659 | 3/1980 | Davis | 252/45 |

OTHER PUBLICATIONS

A. Fusi et al., J. Organometal Chem. (1971) 26(3), 417–430, Homogeneous Cyclohexene Oxidation Catalyzed by Low Valent Tertiaryphosphine–Transition Metal Complexes.

*Primary Examiner*—Glennon H. Hollrah
*Assistant Examiner*—Diana G. Rivers
*Attorney, Agent, or Firm*—Wilson, Fraser, Barker & Clemens

[57] ABSTRACT

A process for catalyzing the sulfurization of olefins and the resulting products are disclosed in which the catalyst is a tertiary phosphine such as a trihydrocarbyl phosphine or a trihydrocarbyl phosphine sulfide. The catalyst is preferably soluble in the olefin and, in the presence of elemental sulfur, the reaction mixture is heated to a temperature sufficient to sulfurize the olefin. The catalyst enables the sulfurization to proceed at lower temperatures than would be employed without catalysis. Atmospheric pressure production is possible of high sulfur-containing olefins which normally boil or reflux strongly at or below sulfurization temperatures. In addition, the product of the catalyzed reaction has certain advantages, such as improved oil solubility with no subsequent dropout.

16 Claims, No Drawings

CATALYZING THE SULFURIZATION OF OLEFINS BY TERTIARY PHOSPHINES, AND AN OIL BASED MATERIAL CONTAINING AN ADDITIVE AMOUNT OF A SULFURIZED OLEFIN SO PRODUCED

BACKGROUND OF THE INVENTION

It is known that sulfurized olefinic materials are useful as additives to lubricants, such as oil-based materials like crankcase oil, gear lubricants, extreme pressure lubricants, automotive transmission fluids, and the like. Sulfurized olefins may also be added to cutting oil and machine oil formulations to lubricate shaping operations of tough ferrous alloys, mild steel, cast iron, and the like.

In general, the olefin is heated in the presence of a sulfur-bearing compound such as under reflux conditions to a sulfurization reaction temperature. After an initial period when all or most of the olefinic material has reacted, further heating may be desirable to complete the reaction. As a rule, at reaction temperatures below about 340° F., the process either takes too long or provides less than desirable products. Sulfurization catalysts have been suggested to speed the reaction. However, many catalysts provide excessive exotherm and often result in products having poor solubility in oil-based materials.

U.S. Pat. No. 4,147,640 to Jayne et al discloses improving lubricating oils by adding a reaction product obtained by reacting an olefinic hydrocarbon with sulfur and hydrogen sulfide. This produces an intermediate reaction product which is reacted with additional olefin hydrocarbons. The initial reaction is preferably carried out with a sulfurization catalyst. Those disclosed include quaternary ammonium salts, quanidines, thiuram sulfides and disulfides, alkyl and cycloalkyl amines, and still others. A catalyst is also used in the second stage such as a thiadiazole.

U.S. Pat. Nos. 4,119,549 and 4,191,659, both issued to Davis, disclose sulfurized compositions as lubricant additives in which the compositions are prepared by reacting under superatmospheric pressure an olefinic compound with a mixture of sulfur and hydrogen sulfide in the presence of an acidic, basic or neutral catalyst. A large number of materials is disclosed as useful catalysts. Neutral or acidic materials include acidified clays, p-toluene-sulfonic acid, and phosphorous sulfides such as phosphorous pentasulfide. Basic catalysts are preferred according to this patent and may include inorganic oxides and salts such as sodium hydroxide, calcium oxide and sodium sulfide. Nitrogen bases may also be used as catalysts such as ammonia and amines.

SUMMARY OF THE INVENTION

An object of the invention is to provide a catalyzed sulfurization of olefins. Another object is to provide such a process that may be carried out at lower temperatures than would be employed without catalysis. A further object is to provide such a process that may, if desired, be carried out at atmospheric pressure. A still further object is to provide an improved sulfurized olefin having enhanced oil solubility with oil-based materials with less dropout or precipitation before and after combination with oil-based materials.

These and other objects are realized by catalyzing the sulfurization of an olefin or mixture of olefins by a catalyst comprising a tertiary phosphine such as a trihydrocarbyl phosphine or a trihydrocarbyl phosphine sulfide.

The olefins used are normally liquid at room temperatures. The catalyst may be dispersed throughout the olefin, but preferably the catalyst is soluble in the unsaturated hydrocarbon. In one form, a reaction mixture of the olefin, elemental sulfur, and the catalyst is heated, usually under reflux conditions, to a temperature and for a time to react the sulfur with the olefin. After the sulfurization, an inert gas may be blown through the reaction mixture to remove volatiles and yield the final product.

DESCRIPTION OF THE PREFERRED EMBODIMENTS

The components of the reaction mixture are discussed, followed by a description of the sulfurization reaction and conditions. Examples provide specific illustrations of the invention.

Olefins useful in the invention comprise many unsaturated organic compounds diverse in nature. Such compounds contain at least one carbon-to-carbon unsaturated bond and are reactive with sulfur. The olefinic double bond may or may not be terminal in the hydrocarbon chain. The olefin may also be polyunsaturated.

Olefins useful in the invention may comprise a hydrocarbon containing from about 2 to 24 carbon atoms and preferably from 8 to about 16 carbon atoms and generally correspond to the structure:

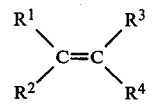

in which $R_1$, $R_2$, $R_3$, and $R_4$ may be the same or different and preferably represent hydrogen, alkyl, isoalkyl, cycloalkyl, alkenyl, aryl and alkaryl, provided that any two of the R substituents may together form an alkylene or substituted alkylene group.

The substituents $R_1$, $R_2$, $R_3$, and $R_4$ are not normally a critical aspect of the invention and may comprise any substituent as long as it is or can be made compatible with lubricating environments and does not interfere with the sulfurizing reaction. Accordingly, substituted olefinic compounds which are so unstable as to decompose under the reaction conditions of the process are not contemplated. However, certain substituents such as keto or aldehydo can undergo sulfurization.

In this respect, saturated substituents such as alkyl are preferred to unsaturated substituents such as alkenyl. The unsaturated substituents compete with the olefinic double bonds for sulfur, and in this regard normally represent an inefficient and not necessarily desirable use of the sulfur reactant. Monoolefinic compounds and especially terminally unsaturated monoolefinic compounds are preferred to the di-unsaturated and tri-unsaturated olefinic compounds. Olefins having medium and lower chain lengths, for example, from about 8 to about 16 carbon atoms, such as decene, octene, diisobutene, triisobutene, nonene, dodecene, and the like, are also preferred because of the high sulfur-containing compositions which can be prepared from them. Acceptable results can be obtained with mixtures of olefins such as mixtures of different types of olefins like aliphatic olefins and alicyclic olefins.

Other specific olefins that may be used include: isobutene, butene, cyclopentene, methylcyclopentene, isodecyl acrylate, cyclohexene, limonene, norbornene, polyisobutene, norbornadiene, octadecene, methyl oleate, styrene, methyl styrene, butadiene, alloocimene, dicyclopentadiene, hexadiene, hexene and the like. Still other examples of alicyclic olefinic hydrocarbons include: cyclohexadiene, cycloheptene, cyclooctene, and the like. The olefin may be straight chained or branched with double bonds terminally or internally. The olefins include unsaturated fats, fatty acids, fatty esters, and all olefinic compositions as disclosed in U.S. Pat. No. 4,119,549 to Davis, which is hereby incorporated by reference.

The catalyst for the sulfurization may be either a trihydrocarbyl phosphine or a trihydrocarbyl phosphine sulfide or a mixture of the two. Useful trihydrocarbyl phosphines preferably, generally correspond to the structure:

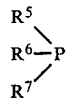

Useful trihydrocarbyl phosphine sulfides preferably, generally correspond to the structure:

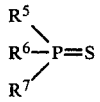

The hydrocarbyl substituents for each of the indicated phosphines and phosphine sulfides may comprise a large variety of substituents containing hydrogen and carbon and, as used here and in the claims, still other atoms as long as the substituent as a whole does not cause the phosphine or phosphine sulfide to decompose under the conditions of the sulfurization reaction or otherwise to interfere with that operation. As a rule, the substituents $R^5$, $R^6$, $R^7$, for each of the trihydrocarbyl phosphines and trihydrocarbyl phosphine sulfides may be the same or different and represent alkyl, isoalkyl, cycloalkyl, alkenyl, isoalkenyl, cycloalkenyl, aralkyl, aryl, alkyl-substituted aryl, isoalkyl-substituted aryl, cycloalkyl-substituted aryl, aralkyl-substituted aryl, alkenyl-substituted aryl, isoalkenyl-substituted aryl, and cycloalkenyl-substituted aryl, each of the $R^5$, $R^6$, and $R^7$ constituents containing up to about 20 carbon atoms. As a general rule, as the number of carbon atoms increases, the catalyst becomes less effective. It is preferred to use the trihydrocarbyl phosphines to the trihydrocarbyl phosphine sulfides. Triaryl phosphines are preferred to the trialkyl phosphines. A preferred phosphine is triphenyl phosphine.

While there is no intent to be bound by theoretical considerations or to limit the claims by them, it appears that the trihydrocarbyl phosphine is converted to the sulfide during the course of the sulfurization reaction. Thus, the trihydrocarbyl phosphine may be more a reaction modifier than a catalyst in the classic sense. In any event, the trihydrocarbyl phosphine sulfide may itself be used as a catalyst in sulfurizing olefins or in an admixture with the trihydrocarbyl phosphine. Use of the catalyst results in a much more controlled reaction and at lower temperatures while producing a high sulfur loading in a readily oil-soluble form.

The sulfur component must be elemental sulfur, that is, it cannot be in another sulfur-bearing form such as hydrogen sulfide. The sulfur should be in powder form to facilitate its dispersion in the reaction mixture. Particle size is not critical, since it is merely a matter of increasing the surface area of the sulfur.

In carrying out the process, the catalyst is mixed with the olefin and the pulverulent sulfur, but the sulfur may be added later, if desired. Preferably, the catalyst is soluble in the olefin although this is not necessary. If insoluble, the catalyst may be mechanically dispersed or otherwise mixed with the olefin. Proportions are not critical. If excess sulfur is used, it can merely be filtered off after the reaction. Depending upon the olefin selected, the olefin may be present in about 50 to about 90 parts by weight to about 10 to about 50 parts by weight of sulfur. A preferred range is 55 to 65 parts by weight of olefin to 35 to 45 parts by weight of sulfur. The catalyst may be present in an amount of about 0.05% to about 2.0% by weight of the combined olefin and sulfur. Catalysis does occur at the lower catalyst level, but more than about 2% is not only wasteful but can lead to poorer oil solubility of the sulfurized products. A more usual range of the catalyst is from about 0.1% to about 0.4% by weight of the combined olefin and sulfur.

The reaction mixture comprising the olefin, sulfur, and catalyst is heated under reflux conditions to a temperature and for a time to sulfurize the olefin. Sulfur is usually present at the start of the heating operation but it can be added at any time. A sulfurizing temperature may be high enough to cause the reaction but not so high as to result in degredation of the reactants or products. The sulfurization temperature may be in the range of about 280° F. to about 460° F. A preferred temperature range is about 320° F. to about 380° F. The time of sulfurization can extend from about 1 to about 12 hours, depending on the reactants and temperature of sulfurization.

Due to the relatively low boiling points of medium and lower chain olefins of from about 8 to about 16 carbon atoms, sulfurization of these olefins at atmospheric pressure has not been regarded as practical. There is normally considerable reflux even when such olefins comprise only a fraction of the reaction mix. When sulfurization of these medium and lower chain length olefins by themselves is desired, sulfurization at atmospheric pressure is even more difficult if at all possible. Accordingly, sulfurization at superatmospheric pressures has previously been followed for these olefins which permit higher temperatures for reasonably fast reactions.

One advantage of the present process is that the medium and low chained olefins can be sulfurized at atmospheric pressure and still obtain high sulfur loadings at relatively low temperatures. When the olefin has a very low boiling point, such as isobutene, it may be desirable to use sufficient superatmospheric pressure to maintain the olefin in a liquid state. However, even in this instance, the present catalyst reduces the superatmospheric pressure that would otherwise be needed and hastens the consumption of the sulfur, that is, accelerates the sulfur reaction.

After sulfurization, the reaction product is blown with an inert gas to remove volatiles such as hydrogen sulfide. Any inert gas may be used which does not significantly react with the sulfurized product. Suitable gases include air, nitrogen, carbon dioxide, argon, and the like. Air is preferred because of its ready availability and low cost. The conditions under which the reaction product is blown are not critical. For example, an inert gas may be passed through the reaction mixture for about 2 to about 3 hours at a temperature within the range of about 280° F. to about 300° F.

Sulfurized olefinic products obtained in accordance with the present invention may contain from about 5% to about 75% by weight of sulfur. Usually the sulfur ranges from about 9% to about 45% by weight and more normally, the sulfur content is in the range of about 30% to about 45% by weight. The sulfurized products make excellent additives to many diverse oil-based materials, including as examples natural oils such as mineral oils, synthetic based oils, lubricants including extreme pressure lubricants, gear lubricants, and the like. The present sulfurized olefins are readily soluble in both paraffinic and naphthenic stocks without clouding, separation, or precipitation. The sulfurized olefins may also be used as friction modifiers in cutting oil formulations used in such operations as broaching, tapping, threading, thread rolling, gear cutting, boring, grinding, turning, milling, drilling, and the like.

The sulfurized olefins as an additive or base may be added to an oil-based material in an amount ranging from about 1% to about 20% by weight of the material, depending upon its ultimate intended use and, more particularly, how much sulfur is desired to be present. During storage, the present sulfurized olefins remain a homogenous liquid with no sulfur crystallization. The sulfurized olefins are readily soluble in many oil-based materials without the "delayed-insolubility" common to some high-sulfur bases, that is, dropout occurs after a period of apparent complete solubility. This often results in dropout or precipitation after the additive and oil-based material have been mixed and allowed to stand for a while. The present sulfurized olefins have low odor and non-skin staining characteristics.

If desired, other known oil modifying additives may be used with the sulfurized olefin or blend of sulfurized olefin and oil-based material, such as detergents, dispersants, corrosion-inhibiting agents, oxidation-inhibiting agents, pour point depression agents, auxilliary extreme pressure agents, color stabilizers, anti-foam agents, and the like.

The following examples only illustrate the invention and should not be construed as limiting the claims. The percentages and parts are by weight unless otherwise indicated.

EXAMPLE 1

This example illustrates the poor results obtained in a sulfurized product when the catalyst is not used. An amount of 63 parts of decene-1 and 37 parts of particulate sulfur were heated at atmospheric pressure for fourteen hours at 320° F. to 325° F. There was only a mild reflux of decene-1 at the beginning, with decreasing reflux as the olefin reacted with the sulfur. After sulfurization, the product was air blown for two hours at 280° F. The product analyzed 32.0% sulfur and showed a black precipitate on standing.

EXAMPLE 2

This example shows the poor results obtained in a sulfurized olefin without a catalyst even when the reaction is carried out under superatmospheric pressure. An amount of 63 parts of decene-1 and 37 parts of sulfur were charged into an autoclave rated at 150 pounds per square inch. After purging the autoclave with nitrogen, the mixture was heated to 340° F. when exotherm started. Even with rapid external cooling, the temperature rose to 420° F., and there was a pressure buildup to 90 pounds per square inch. The reaction was brought under control by cooling and held for four hours at 360° F. to 380° F., followed by air blowing to remove large quantities of hydrogen sulfide. In addition, there was also a large quantity of mercaptan recovered by the blowing. The product contained 32.8% sulfur by analysis, and considerable dropout occurred from the product on standing. Yield was 85%.

EXAMPLE 3

An amount of 57 parts of decene-1, 43 parts of powdered sulfur, and 0.2 part of triphenyl phosphine were charged to a three-neck, round bottom flask having a water-cooled reflux condenser. The reaction mixture was heated to a temperature within the range of about 320° F. to about 325° F. until all of the sulfur had reacted. This required about ten hours. The product was then air blown for 1.5 hours at 300° F. The yield was 99%. The product upon analysis was shown to contain 43.6% sulfur and was stable on standing with no dropout at all. The product had better than usual color and excellent oil solubility.

EXAMPLE 4

The reaction time of Example 3 was shortened considerably, using the same olefin and sulfur charge as there described, but with the following procedure. The reaction mixture was heated to about 320° F. when the reaction started and with continued heating was concluded in about thirty minutes at a temperature within the range of about 330° F. to about 340° F. While exothermic heat was quite obvious due to the rapid reaction of the sulfur, there was little reflux of decene-1 as most of it had already reacted. The temperature was allowed to rise to about 360° F. but was otherwise controlled by external cooling. The product was held at 360° F. for about three hours and then air blown to remove any volatiles such as hydrogen sulfide. The resulting product had no dropout on standing and showed excellent paraffinic oil solubility.

EXAMPLE 5

A procedure was carried out like the procedure of Example 4, except that the catalyst was tributyl phosphine in an amount of 0.2% of the combined olefin and sulfur. There was somewhat more reflux of decene during the exotherm. The product by analysis was shown to have 39.8% sulfur and possessed excellent oil stability.

EXAMPLE 6

A procedure was carried out like the procedure of Example 3, except that the catalyst was triphenyl phosphine sulfide in an amount of 0.22% by weight of the combined olefin and sulfur. The temperature was allowed to rise to about 380° F. The product contained 38.8% sulfur and had excellent paraffinic oil solubility. There was no dropout on standing. The yield was 98.6%.

EXAMPLES 7 AND 8

These examples illustrate the differences in properties between sulfurized olefins obtained with and without the use of the present catalyst. In each case, the charge to a three-neck, round bottom flask was 220 grams of decene-1 and 160 grams of sulfur. In Example 7, no catalyst was used, while in Example 8 the charge included 0.8 gram of triphenyl phosphine. Instead of the usual water-cooled reflux condenser, a known condenser was used which collected the distillate and did not return it to the flask. After initially stirring for about thirty minutes at 315° F. to 320° F., the reaction mixture was heated strongly during the next ten minutes to 390° F. so that the lower boiling materials, including unreacted olefins, could be collected. After collection of the distillate, weighing, and removal of a small sample for gas chromatographic analysis, the distillate was recombined with the reaction mixture after cooling it to about 320° F. The reaction of the recombined mixture was then continued for three hours at 355° F. to 360° F., followed by sufficient air blowing to remove volatiles. Table A lists the data obtained.

TABLE A

| | Example 7 (UNCATALYZED) | Example 8 (CATALYZED) |
|---|---|---|
| Weight of Distillate | 33.8 g. | 27.1 g. |
| Analysis of Distillate | 95% decene-1 | 45% decene-1 |
| Unreacted decene-1, % of starting decene-1 | 15% | 6% |
| Final product, weight | 362.8 g. | 366.0 |
| Final product, yield | 95.5 | 96.3 |
| % sulfur, analyzed | 40.2 | 40.1 |
| Product Appearance | Small amount drop-out on standing | No dropout |
| 5% Product Dissolved in oil based material | Appeared to dissolve, but ppt. overnight, increasingly worse with time. | Clear and stable after 4 weeks. |

It will be noted that the uncatalyzed run of Example 7 had more than twice the amount of decene-1 in the distillate as compared to the catalyzed run of Example 8. The oil-based material, into which 5% of the sulfurized olefin was dissolved, was a paraffinic oil having a 100 SUS viscosity of 100° F. The product of the uncatalyzed run of Example 7 when dissolved in such an oil precipitated overnight and became increasingly worse with time. However, the product of the catalyzed run of Example 8 when dissolved in the same oil was clear and stable with no dropout even after four weeks.

EXAMPLE 9

The charge to a three-neck, round bottom flask equipped with a reflux condenser included 70% propylene tetramer, 30% sulfur, and 0.2% triphenyl phosphine. The charge had the following heat history: 1.5 hours at 280° F. to 310° F.; 1.0 hour at 310° F.; to 325° F.; 1.5 hours at 320° F. to 330° F.; and finally 5 hours at 330° F. to 340° F. The product was then blown with air for two hours at 240° F. to 300° F. The product contained 25.7% sulfur, a good odor, and a dark appearance. The yield was 97.6%.

EXAMPLE 10

The charge in this case included two olefins and comprised 33.5% decene-1, 33.5% propylene tetramer, 33% sulfur, and 0.2% triphenyl phosphine. The charge was heated quickly to 340° F. when a strong exotherm started, although resulting in only a slight reflux. The heating was continued to 408° F. with no further substantial reflux, although hydrogen sulfide was detected. The heating schedule continued with two hours at 360° F. to 380° F. and then 1.5 hours at 320° F. to 360° F. After air blowing the product for two hours at about 300° F., the product was analyzed and found to contain 31.6% sulfur. The yield was 96.0%.

EXAMPLE 11

This example illustrates the use of the invention with fats. The charge to a three-neck, round bottom flask included:

| | |
|---|---|
| White Grease | 46.9% |
| Polybutene | 18.7% |
| Olefins ($C_{15}$ to $C_{18}$) | 6.6% |
| Soybean Oil | 8.3% |
| Sulfur | 19.5% |
| | 100.0 |

The catalyst was triphenyl phosphine in an amount of 0.2% of the charge. The reaction mixture was heated, although sulfur was not added until the temperature reached 270° F. Thereafter the reaction mixture was further heated at 360° F. to 365° F. for about 3.5 hours. The product contained 16.3% sulfur and had good solubility in oil-based materials. The yield was 90.2%.

Although the foregoing describes several embodiments of the present invention, it is understood that the invention may be practiced in other forms within the scope of the following claims.

We claim:

1. In the catalytic sulfurization of olefins by the mixing of said olefin with elemental sulfur, the improvement comprising using as the catalyst a tertiary phosphine selected from the group consisting of a trihydrocarbyl phosphine and a trihydrocarbyl phosphine sulfide.

2. The process of claim 1 in which said phosphine and phosphine sulfide have a sufficiently low molecular weight to be soluble in said olefin.

3. A process for sulfurizing olefins comprising contacting an olefin and elemental sulfur with a catalytic amount of a catalyst selected from the group consisting of a trihydrocarbyl phosphine and a trihydrocarbyl phosphine sulfide, and heating the resulting reaction mixture to a temperature sufficient to sulfurize the olefin.

4. The process of claim 3 in which said olefin comprises a hydrocarbon containing from two to about 24 carbon atoms and corresponding to the structure:

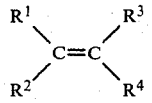

in which $R^1$, $R^2$, $R^3$ and $R^4$ may be the same or different and represent hydrogen, alkyl, isoalkyl, cycloalkyl, alkenyl, aryl, and alkaryl, provided further that any two of the R substituents may together form an alkylene or substituted alkylene group.

5. The process of claim 3 in which said trihydrocarbyl phosphine corresponding to the structure:

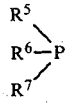

in which $R^5$, $R^6$, and $R^7$ may be the same or different and represent alkyl, isoalkyl, cycloalkyl, alkenyl, isoalkenyl, cycloalkenyl, aralkyl, aryl, alkyl-substituted aryl, isoalkyl-substituted aryl, cycloalkyl-substituted aryl, isoalkenyl-substituted aryl, and cycloalkenyl-substituted arly, each of said $R^5$, $R^6$ and $R^7$ substituents containing up to about 20 carbon atoms.

6. The process of claim 3 in which said trihydrocarbyl phosphine sulfide corresponding to the structure:

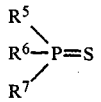

in which $R^5$, $R^6$, and $R^7$ may be the same or different and represent alkyl, isoalkyl, cycloalkyl, alkenyl, isoalkenyl, cycloalkenyl, aralkyl, aryl, alkyl-substituted aryl, isoalkyl-substituted aryl, cycloalkyl-substituted aryl, aralykl-substituted aryl, alkenyl-substituted aryl, isoalkenyl-substituted aryl, and cycloalkenyl-substituted aryl, each of said $R^5$, $R^6$, and $R^7$ substituents containing up to about 20 carbon atoms.

7. The process of claim 3 in which said heating is in the range of about 280° F. to about 460° F. for about one to about 12 hours.

8. The process of claim 3 in which said process is carried out at atmospheric pressure.

9. The process of claim 3 in which said process is carried out a superatmospheric pressure sufficiently high to maintain said olefin in a liquid state.

10. The process of claim 3 including blowing an inert gas through the reaction mixture following sulfurization to remove volatiles.

11. The process of claim 3 in which said trihydrocarbyl phosphine is triphenyl phosphine.

12. A process for sulfurizing olefins comprising dissolving a catalyst for the sulfurization in the olefin in the presence of elemental sulfur, and heating the resulting reaction mixture at a temperature sufficient to sulfurize the olefins catalytically, said catalyst being a trihydrocarbyl phosphine and corresponding to the structure:

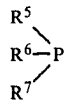

in which $R^5$, $R^6$, and $R^7$ may be the same or different and represent alkyl, isoalkyl, cycloalkyl, alkenyl, isoalkenyl, cycloalkenyl, aralkyl, aryl, alkyl-substituted aryl, isoalkyl-substituted arly, cycloalkyl-substituted aryl, aralkyl-substituted aryl, alkenyl-substituted aryl, isoalkenyl-substituted aryl, and cycloalkenyl-substituted aryl, each of said $R^5$, $R^6$ and $R^7$ substituents containing up to about 20 carbon atoms, said olefin comprising a hydrocarbon containing from two to about 24 carbon atoms and generally corresponding to the structure:

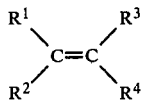

in which $R^1$, $R^2$, $R^3$, $R^4$ may be the same or different and represent hydrogen, alkyl, isoalkyl, cycloalkyl, alkenyl, aryl, and alkaryl, provided further that any two of the R substitutents may together form an alkylene or substituted alkylene group.

13. A sulfurized olefin produced in accordance with the process of claim 1.

14. A sulfurized olefin produced in accordance with the process of claim 3.

15. A sulfurized olefin produced in accordance with the process of claim 12.

16. An oil based material containing an additive amount of a sulfurized olefin produced in accordance with the process of claim 1.

* * * * *